US012559944B2

(12) United States Patent
Sunayama

(10) Patent No.: US 12,559,944 B2
(45) Date of Patent: Feb. 24, 2026

(54) COUPLER FOR THREADED REINFORCING BAR AND THREADED REINFORCING BAR INCLUDING THE COUPLER

(71) Applicant: GODO STEEL, LTD., Osaka (JP)

(72) Inventor: Naoaki Sunayama, Tokyo (JP)

(73) Assignee: GODO STEEL, LTD., Osaka (JP)

( * ) Notice: Subject to any disclaimer, the term of this patent is extended or adjusted under 35 U.S.C. 154(b) by 0 days.

(21) Appl. No.: 18/864,010

(22) PCT Filed: May 12, 2023

(86) PCT No.: PCT/JP2023/017830

§ 371 (c)(1),
(2) Date: Jul. 7, 2025

(87) PCT Pub. No.: WO2023/219150

PCT Pub. Date: Nov. 16, 2023

(65) Prior Publication Data

US 2025/0327303 A1 Oct. 23, 2025

(30) Foreign Application Priority Data

May 12, 2022 (JP) ..... 2022-078707

(51) Int. Cl.
*E04C 5/16* (2006.01)

(52) U.S. Cl.
CPC ..... *E04C 5/165* (2013.01)

(58) Field of Classification Search
CPC ..... E04C 5/165
See application file for complete search history.

(56) References Cited

U.S. PATENT DOCUMENTS

| | | | |
|---|---|---|---|
| 4,666,326 | A | 5/1987 | Hope |
| 5,046,878 | A | 9/1991 | Young |
| 7,107,735 | B2 | 9/2006 | Hopwood |

FOREIGN PATENT DOCUMENTS

| | | | |
|---|---|---|---|
| EP | 3168386 | A1 | 5/2017 |
| JP | S56162721 | U | 12/1981 |
| JP | H11229557 | A | 8/1999 |
| JP | 2003239458 | A | 8/2003 |
| JP | 20145703 | A | 1/2014 |

(Continued)

OTHER PUBLICATIONS

International Search Report issued on Jun. 13, 2023 for PCT application No. PCT/JP2023/017830.

*Primary Examiner* — Adriana Figueroa
(74) *Attorney, Agent, or Firm* — Li & Cai Intellectual Property Office

(57) ABSTRACT

A coupler includes one main cylinder, and two sub-cylinders. A hole in an axial direction formed in the inside of the main cylinder is a through hole to which a thread of the reinforcing bars is screwed, and outer peripheral screws are formed in the outer peripheries of the right and left half bodies of the main cylinder. The screws have pitches that are different from a screw pitch $P_4$ of the thread of the reinforcing bars. The sub-cylinders are formed with nut portions in one side ends of the sleeve portions covering the outer peripheries of the right and left half bodies of the main cylinder, sleeve inner peripheral screws that are screwed with the outer peripheral screws are formed in the sleeve portions, and the nut portions are formed with nut portion female screws to which the thread of the reinforcing bar is screwed.

10 Claims, 12 Drawing Sheets

(56) References Cited

FOREIGN PATENT DOCUMENTS

| | | | |
|---|---|---|---|
| JP | 2016532029 | A | 10/2016 |
| JP | 2018178365 | A | 11/2018 |
| KR | 200409526 | Y1 | 3/2006 |
| KR | 1020210075660 | A | 6/2021 |

COUPLER FOR THREADED REINFORCING BAR AND THREADED REINFORCING BAR INCLUDING THE COUPLER

FIELD OF THE DISCLOSURE

The present invention relates to a coupler for a threaded reinforcing bar, and particularly to a coupler to which end portions of threaded reinforcing bars facing each other are inserted, the coupler being fastened to the reinforcing bars in order to prevent loosening of the reinforcing bars and the coupler and make the reinforcing bars through which an axial force is transmitted long. The present invention also relates to a threaded reinforcing bar including the coupler.

BACKGROUND OF THE DISCLOSURE

When reinforced concrete is used to construct a building or a civil engineering structure, a deformed reinforcing bar (threaded reinforcing bar or bamboo-shaped reinforcing bar) used as a concrete reinforcing material is manufactured to have a standard length of, for example, 12 meters in consideration of convenience of transporting from shipping from a factory to a construction site.

However, in use, in order to correspond to a size of a building to which the deformed reinforcing bar is applied or a length of a position to which the deformed reinforcing bar is applied, the deformed reinforcing bar is often extended at the construction site. In both cases of a threaded reinforcing bar and a bamboo-shaped reinforcing bar (a bamboo-shaped reinforcing bar is out of the scope of the present invention), the reinforcing bar is molded by being gradually deformed by calibers formed on a roll in a rolling process, and the roll becomes rough or worn even little by little. Although the roughness can be removed by surface grinding for continuous using, a decrease in a roll diameter is inevitable, and a thread pitch varies even slightly depending on a manufacturing period. On the other hand, a tooth shape formed in a bonding hole of the coupler is formed by cast molding in consideration of a molding tolerance of the reinforcing bar while being made to correspond to the thread pitch of a normal dimension of the reinforcing bar. Accordingly, although meshing can be achieved by absorbing a difference in the screw pitch between the coupler and the reinforcing bar, a gap in the meshing is inevitably remained.

For preventing looseness, the gap between tooth surfaces is filled with grout (for example, mortar), or, for fall prevention, a small screw is set to erect toward a surface of the reinforcing bar from the outside of the coupler. Examples of the former case are disclosed in Patent Documents 1 and 2 and examples of the latter case are disclosed in Patent Documents 3 and 4. In any of the cases, attempting to make fastening perfect causes a long length of the coupler and an increased fastening load. Therefore, a coupler is desired, in which torque management (achievement of fastening with a small torque and even fastening force) is easy, the torque management showing an effect of preventing occurrence of looseness or fall.

PRIORITY ART DOCUMENTS

Patent Documents

Patent Document 1: U.S. Pat. No. 4,666,326.
Patent Document 2: Japanese Patent Application Publication No. 2018-178365.
Patent Document 3: U.S. Pat. No. 5,046,878.
Patent Document 4: U.S. Pat. No. 7,107,735.

SUMMARY OF THE DISCLOSURE

Problems to be Solved

The present invention has been made in view of the above-described circumstances, and an object thereof is to provide a coupler for bonding threaded reinforcing bars facing each other by using galling of screw threads with respect to each other, without necessarily introducing grout or a screw lock agent to a sleeve, and a threaded reinforcing bar including the coupler.

Means for Solving Problems

With reference to FIG. 1, a first aspect of the present invention is a coupler for a threaded reinforcing bar to which end portions of reinforcing bars 4L, 4R facing each other are inserted, the coupler being fastened to the reinforcing bars 4L, 4R in order to prevent loosening of the reinforcing bars and the coupler and make the reinforcing bars through which an axial force is transmitted long, wherein

- a coupler 10 includes one main cylinder 11, and two sub-cylinders 12, 13 threadingly attached to an outer periphery of a left half body and an outer periphery of a right half body of the main cylinder 11 in a right and left symmetrical posture,
- a hole in an axial direction formed in the inside of the main cylinder 11 is a vertically passing screw hole H5 to which a thread M4 of the reinforcing bars 4L, 4R is screwed,
- outer peripheral screws 6, 7 being concentric with the vertically passing screw hole H5 and having a larger diameter than the vertically passing screw hole H5 are formed in the outer peripheries of the right and left half bodies, end portion male screws M6, M7 are provided in the outer peripheral screws 6, 7,
- the end portion male screws M6, M7 have a phase that matches a phase of a female screw F5 of the vertically passing screw hole H5, and have pitches P6, P7 that are different from a screw pitch P4 of the thread M4 of the reinforcing bars 4L, 4R,
- the sub-cylinders 12, 13 include sleeve portions 8, 9 including end portion female screws F8, F9 threadingly attached to the end portion male screws M6, M7, and nut portions 14, 15 being coaxial with the sleeve portions and formed integrally with one side ends of the sleeve portions, and
- the nut portions 14, 15 are formed with nut portion female screws F14, F15 to which the thread M4 of the reinforcing bars 4L, 4R is screwed, the nut portion female screws F14, F15 having a phase that matches a phase of the end portion female screws F8, F9.

As shown in FIG. 12, a second aspect of the present invention is a coupler for a threaded reinforcing bar comprising a main cylinder 11A and sub-cylinders 12A, 13A whose female and male of screws are inversed from female and male of screws of the main cylinder 11 and the sub-cylinders 12, 13, and a desired lock using galling is enabled.

As shown in FIG. 6, the outer periphery of the left half body and the outer periphery of the right half body of the main cylinder 11 are formed with end portion male screws M6, M7 having pitches $P_6$, $P_7$ larger than a pitch $P_4$ of the thread M4 of the reinforcing bars.

As shown in FIG. 11(*b*), the outer periphery of the left half body and the outer periphery of the right half body of the main cylinder 11 are formed with end portion male screws M6, M7 having pitches $P_6$, $P_7$ smaller than a pitch $P_4$ of the thread M4 of the reinforcing bars 4L, 4R.

As shown in FIG. 12, an inner hole of the left half body and an inner hole of the right half body of the main cylinder 11 are formed with end portion female screws F6, F7 having pitches $P_6$, $P_7$ larger than a pitch $P_4$ of the thread M4 of reinforcing bars 4L, 4R. In addition, an inner hole of the left half body and an inner hole of the right half body of the main cylinder 11A are formed with end portion female screws F6, F7 having pitches $P_6$, $P_7$ smaller than a pitch $P_4$ of the thread M4 of the reinforcing bars 4L, 4R.

As shown in FIG. 4, an outer surface of a longitudinal center portion of the main cylinder 11 is formed with a reaction receiving surface 11C used in application of a desired torque to the nut portions 14, 15.

The longitudinal middle portion of the main cylinder 11 is formed with a slit 17 extending in the axial direction through which a distal end position of the reinforcing bars 4L, 4R that have been inserted can be visually checked. A slit 18 having the same shape as a shape of the slit 17 is formed at a position facing the slit 17.

As shown in FIG. 11(*c*), an end portion of the reinforcing bar in a side opposite to the coupler includes a bending portion 25 that exhibits a fixation plate function.

Advantageous Effects of the Invention

According to the above-described first aspect, since the coupler includes the main cylinder and the two sub-cylinders having a right and left symmetrical posture, reinforcing bars to be connected are respectively bonded with equivalent components and can be fastened by torque loading operation in a similar manner. Even when there is a difference within a manufacturing tolerance in thread pitches, if the reinforcing bars have a thread within a molding tolerance, homogenization of fastening of reinforcing bars can be achieved. Since there is a difference in the pitch between the outer peripheral screws of the outer periphery of the left half body and the outer periphery of the right half body of the main cylinder and the thread of the reinforcing bar, a frictional force acting on a screw surface becomes large due to an increase in a screw surface contact pressure that a screw thread having a small pitch receives, along with screw advancement of the screw. When surface roughness of a screw thread occurs due to galling caused by pressurization, even when it is slight surface roughness, screw advancement or retreat thereafter is inhibited, so that releasing of over-threading of the screw thread does not occur anymore unless a reverse torque corresponding to a load torque acts. According to the above-described second aspect, since there is a difference in the pitch between the end portion female screws of the inner hole of the left half body and the inner hole of the right half body of the main cylinder and the thread of the reinforcing bar, a frictional force acting on a screw surface becomes large due to an increase in a screw surface contact pressure that a screw thread having a small pitch receives, along with screw advancement of the screw. When surface roughness of a screw thread occurs due to galling caused by pressurization, even when it is slight surface roughness, screw advancement or retreat thereafter is inhibited.

Since the outer periphery of the left half body and the outer periphery of the right half body of the main cylinder are formed with the outer peripheral screw having a pitch larger than a pitch of the thread of the reinforcing bar or formed with the outer peripheral screw having a pitch smaller than a pitch of the thread of the reinforcing bar, due to this pitch difference, a large frictional force acting on a surface of the screw due to a screw surface contact pressure acts and firm fastening is made with a galling of the screws. Regarding convenience of fastening, in the coupler according to the present invention, fastening can be made without rotating the threaded reinforcing bar.

Since the inner hole of the left half body and the inner hole of the right half body of the main cylinder are formed with the end portion female screw having a pitch larger than a pitch of the thread of the reinforcing bar or formed with the end portion female screw having a pitch smaller than a pitch of the thread of the reinforcing bar, due to this pitch difference, a large frictional force acting on a surface of the screw due to a screw surface contact pressure acts and firm fastening is made with a galling of the screws.

By forming a reaction receiving surface on an outer surface of a center body being a longitudinal center portion of the main cylinder, receiving a reaction force when a desired torque is applied to the nut portion becomes easy. When a slit extending in the axial direction is formed in a center body being a longitudinal middle portion of the main cylinder, a distal end position of the inserted reinforcing bar can be checked. When another slit having the same shape as the slit is formed in a position facing the slit, viewing through is enabled and checking of the distal end position of the inserted reinforcing bar is facilitated.

By providing a bending portion in the end portion in the side opposite to the coupler of the reinforcing bar, a fixation plate function can be exhibited.

DETAILED DESCRIPTION OF THE EXEMPLARY EMBODIMENTS

Figure 2:
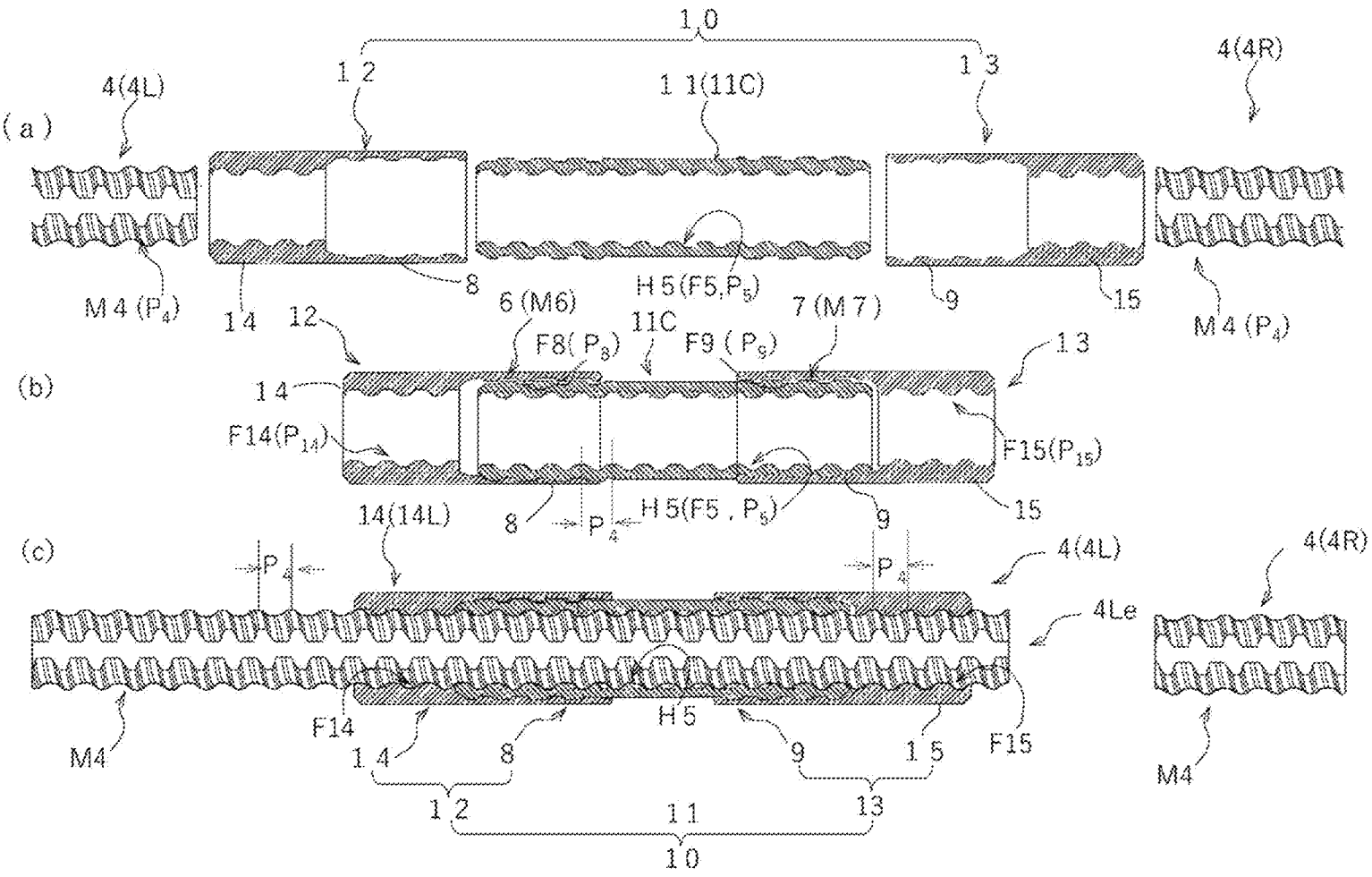
FIG. 2 is a view showing a former half process of a procedure of fastening reinforcing bars by the coupler for a threaded reinforcing bar.

Hereinafter, a coupler for a threaded reinforcing bar according to the present invention will be described with reference to the drawings showing embodiments thereof. This invention is used for fastening threaded reinforcing bars 4L, 4R facing each other as shown in FIG. 2(*a*) in a manner shown in FIG. 3(*c*). That is, this present invention is to bond rigidly reinforcing bars by using galling of screw threads in either case of using grout and not using grout.

A coupler 10, in which end portions facing each other of two reinforcing bars 4L, 4R shown in FIG. 2(*a*) are inserted, prevents loosening of screwing with the reinforcing bar 4 to extend the length of the reinforcing bar through which an axial force is transmitted. This coupler 10 includes one main cylinder 11 and sub-cylinders 12, 13 arranged in right and left symmetrical, that is, provided for each reinforcing bar. Accordingly, the coupler 10 consists of three components and is significantly simple and less bulky. All of the components are rigid bodies made of metal and in principle, they are casting as described later.

Figure 4:
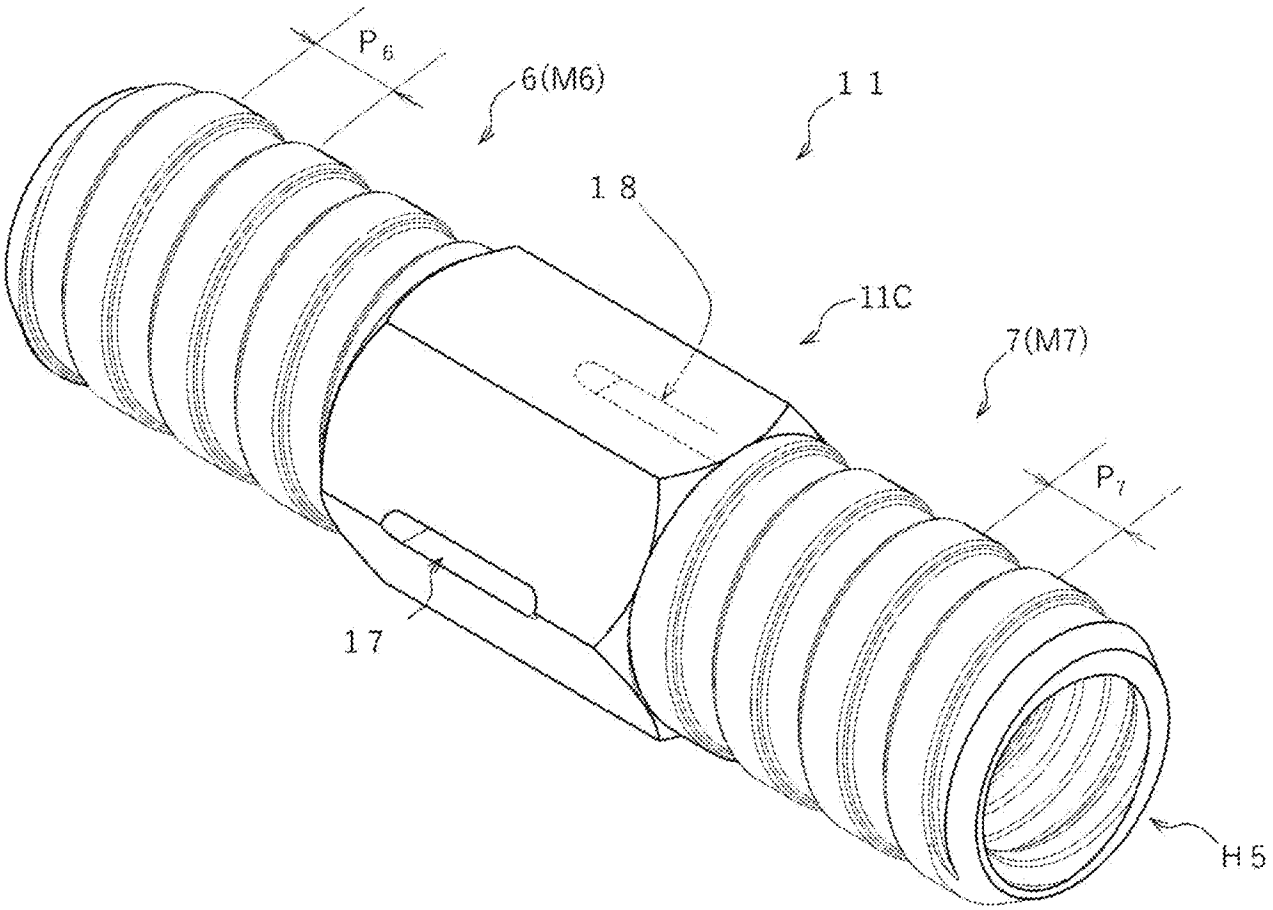
FIG. 4 is a perspective view of appearance of a main cylinder.
Figure 5:
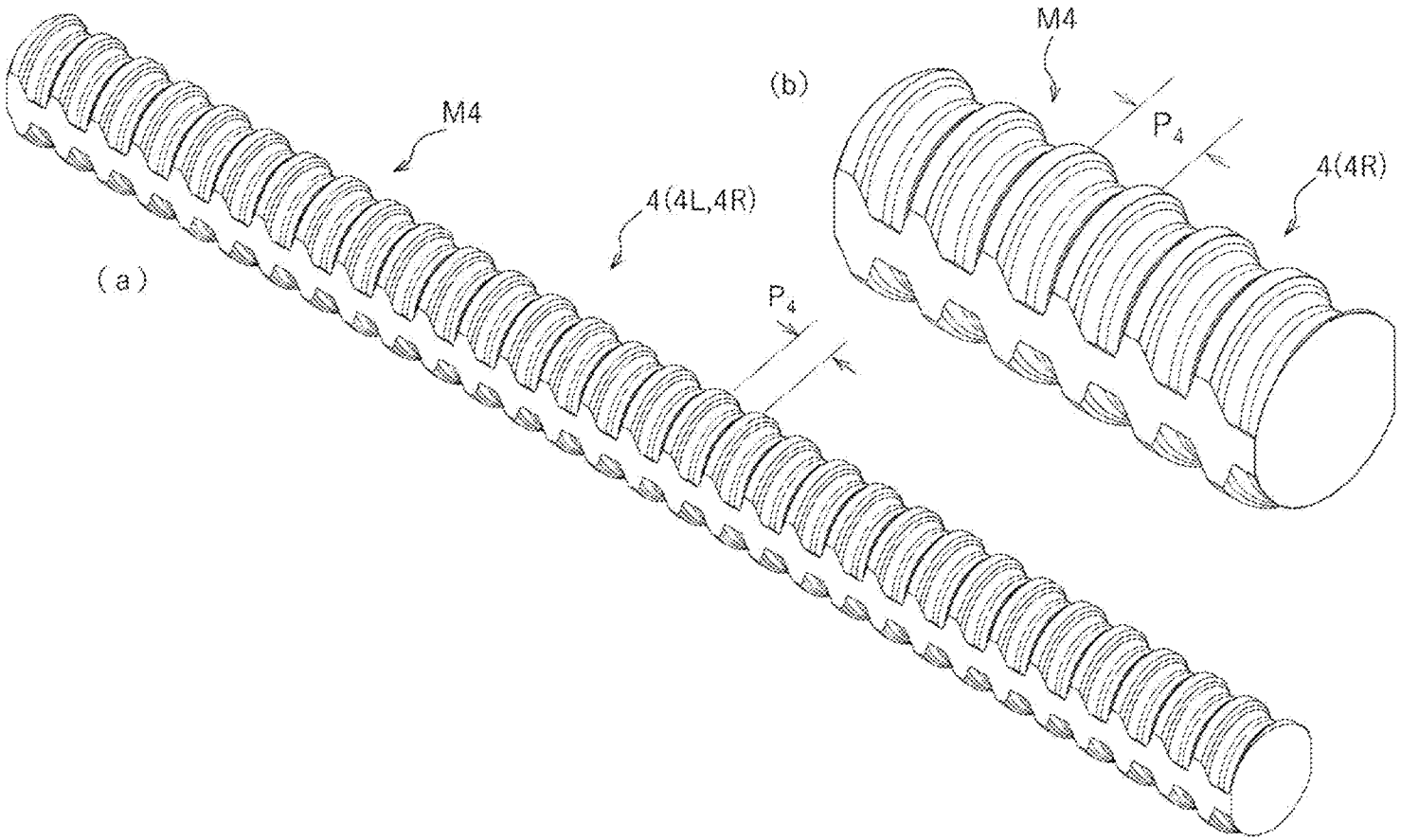
FIG. 5 is a perspective view of a threaded reinforcing bar along and a partially enlarged view thereof.

The main cylinder 11 is a cylinder having appearance shown in FIG. 4 with an outer diameter of about 1.4 times a diameter of the reinforcing bar, for example. A center body 11C forms a polygonal surface (hexagonal face in the drawing) that enables reverse torque application at the time of fastening. Outer surfaces of a left half body and a right half body of the main cylinder 11 are formed with male screws M6, M7 as described later. A hole in the axial direction formed in the inside of the main cylinder 11 is a through hole H5 (see FIG. 4) that is screwed with a thread M4 (see FIG. 5) of the reinforcing bars 4L, 4R even if there is a meshing gap (including a rear gap).

Figure 3:
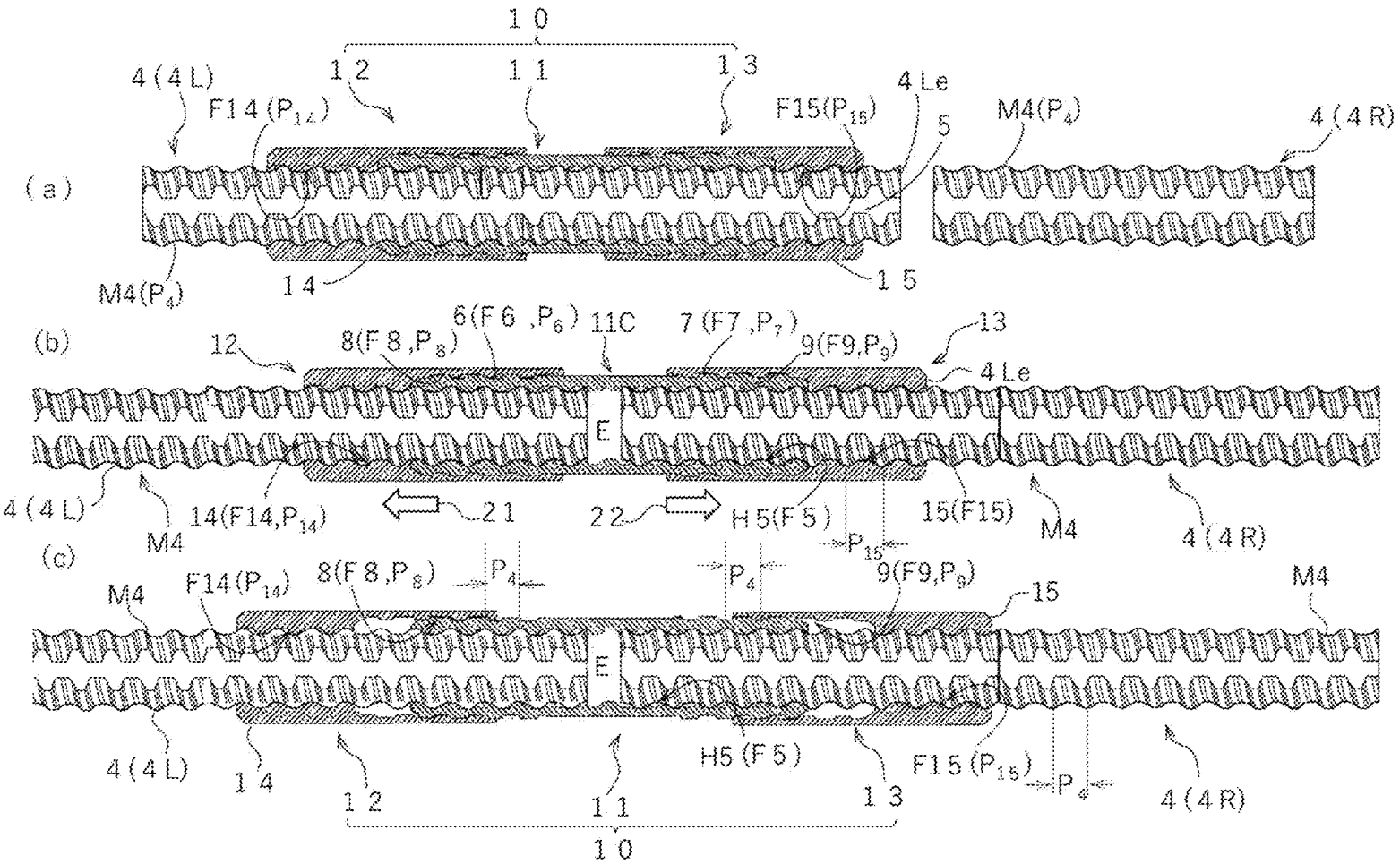
FIG. 3 is a view showing a latter half process of fastening reinforcing bars including processing of meshing of both reinforcing bars and pitch alignment using a gauge.

This through hole H5 is generally a right screw in both the left half body and the right half body. The through hole H5 includes a sufficient number of female screws F5 (see FIG. 6, for example, five or six) for meshing and bonding with the screw thread M4 of the reinforcing bars 4L, 4R that exhibit a predetermined fastening performance. The pitch of the thread from one opening end to the other opening end of this through hole H5 is fixed. The screw phase is the same in the left half body and the right half body regardless of whether the spiral in the through hole H5 is interrupted (not shown) or not (in the portion having a viewing hole of the E part in FIG. 6, the through hole H5 is not interrupted). That is, even one reinforcing bar 4 can be screwed into and penetrate through the screw hole H5 (see FIG. 2(*c*)). This is because this screw hole H5 and nut portion female screws F14, F15 described later of the sub-cylinders 12, 13 described above form screws having screw phases matching each other in a state of being covered with the sub-cylinders 12, 13 up to a deep portion in the depth as shown in FIG. 3(*b*). Regarding prefixes of signs, H refers to a hole portion, M refers to a male screw, F refers to a female screw, and P refers to a pitch. Also hereinafter, members and portions will be described such that they can be recognized easily.

It is needless to say that the number of female screws F5 (see FIG. 6) is sufficient for achieving meshing necessary for fastening if the reinforcing bar is one in which a molding tolerance in consideration of wear of a molding roll is allowed. That is, the female screw F5 of the through hole H5 existing in the inside of the main cylinder 11 has a number of spirals that enables normal threading attachment without interference of tooth surfaces while satisfying meshing of a desired pitch number in either case where the reinforcing bar has the tolerable maximum pitch or the tolerable minimum pitch.

For example, when a target is a reinforcing bar having D35 (a nominal diameter is 35 mm), the main cylinder 11 needs meshing of an amount of 5 or 6 pitches in one side and 12 pitches for right and left. Even when a reinforcing bar end abutting space E (see FIG. 6) at the center is added to the pitches, it is sufficient that the coupler has a length of about 300 mm at most.

Figure 6:
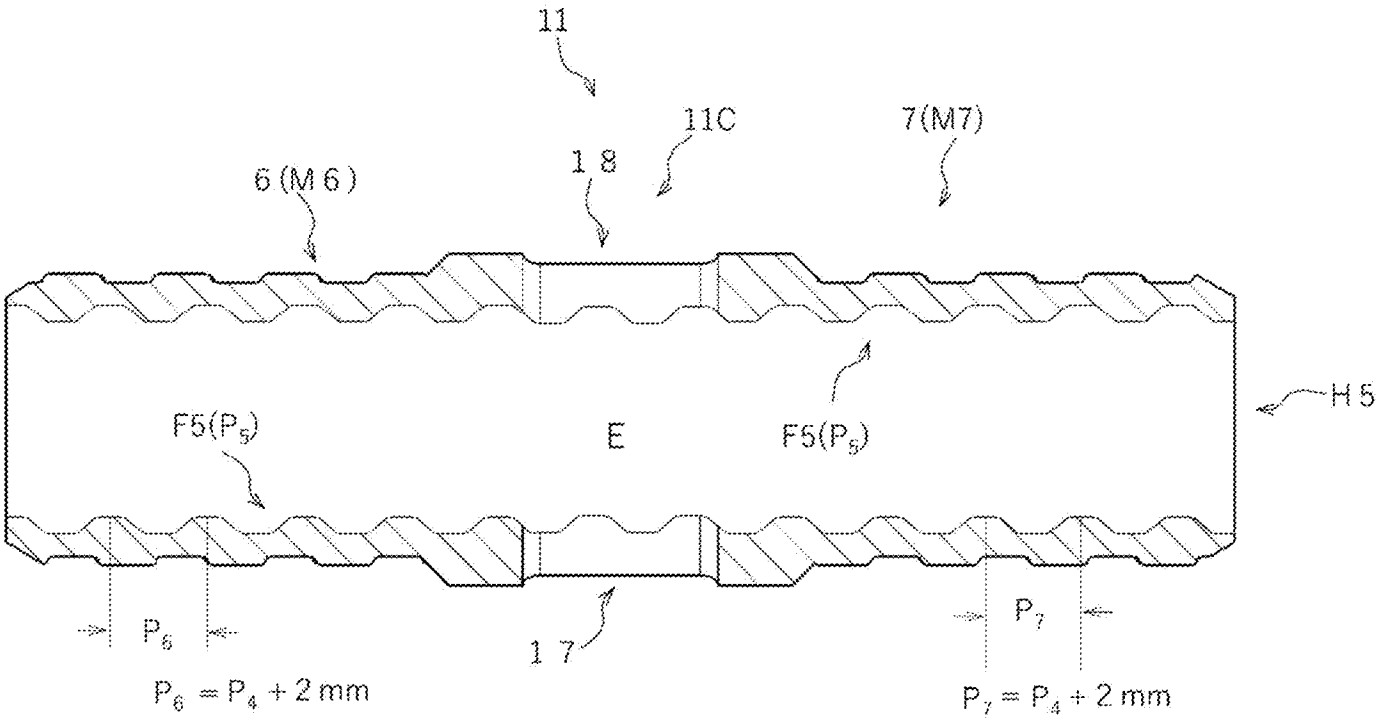
FIG. 6 is a vertical cross-sectional view of the main cylinder.

As shown in FIG. 6, in the outer periphery of the left half body and the outer periphery of the right half body of the main cylinder 11 are formed with outer peripheral screws 6, 7 being concentric with the through hole H5, having a phase matching a phase of the through hole H5, and having pitches $P_6$, $P_7$ (see FIGS. 4 and 6) not equal to a pitch $P_4$ (see FIG. 5) of the thread M4 of the reinforcing bar 4. For example, a dimension of $P_7=P_4+2$ mm is selected. The difference of 2 mm is given for generating galling and enabling absorbing of accumulated pitch molding tolerances of an amount of several pitches in the case that there is such accumulation of pitch molding tolerance (for example, ±0.2 mm each) of the reinforcing bar.

Figure 7:
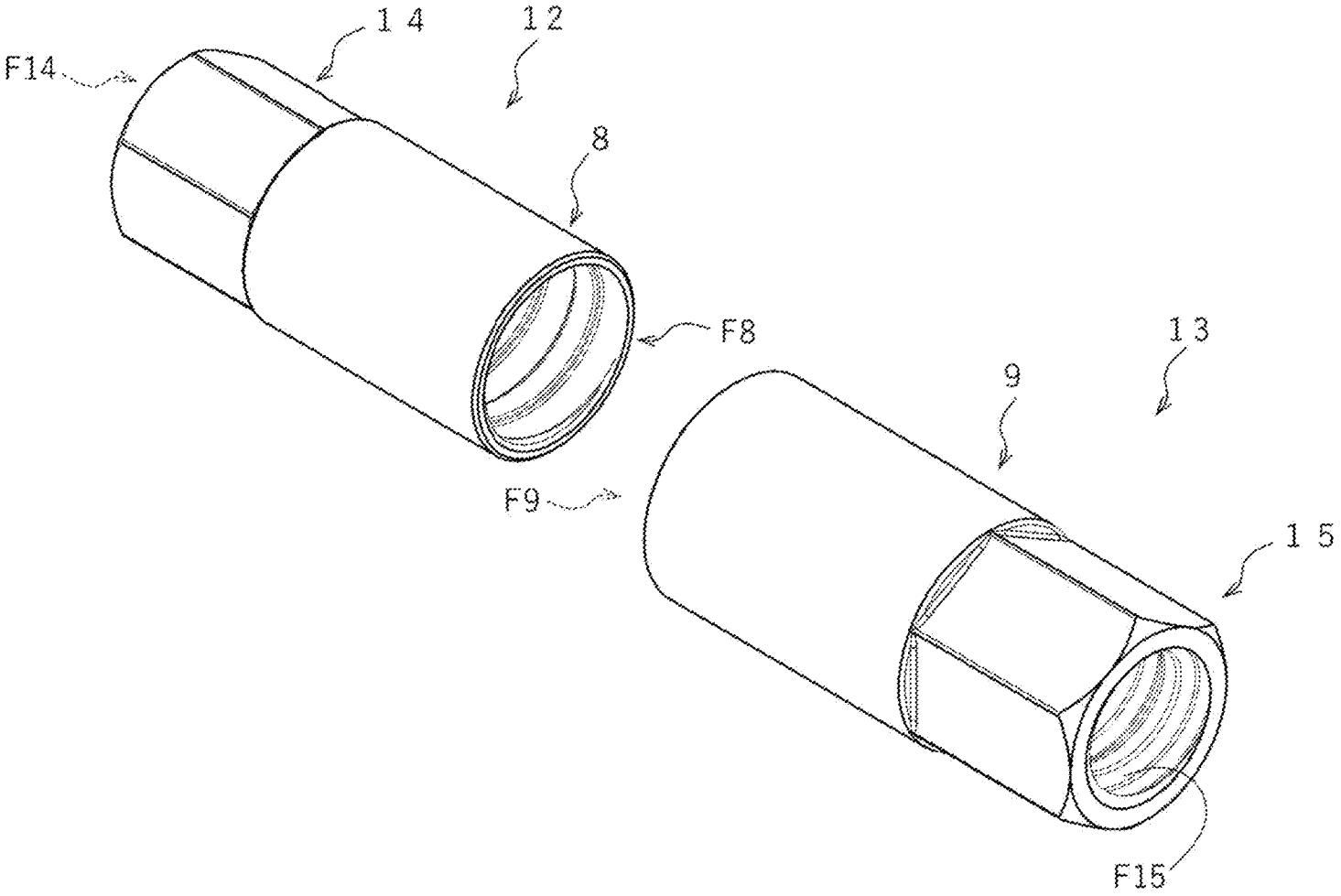
FIG. 7 is a perspective view of appearance of sub-cylinders.
Figure 8:
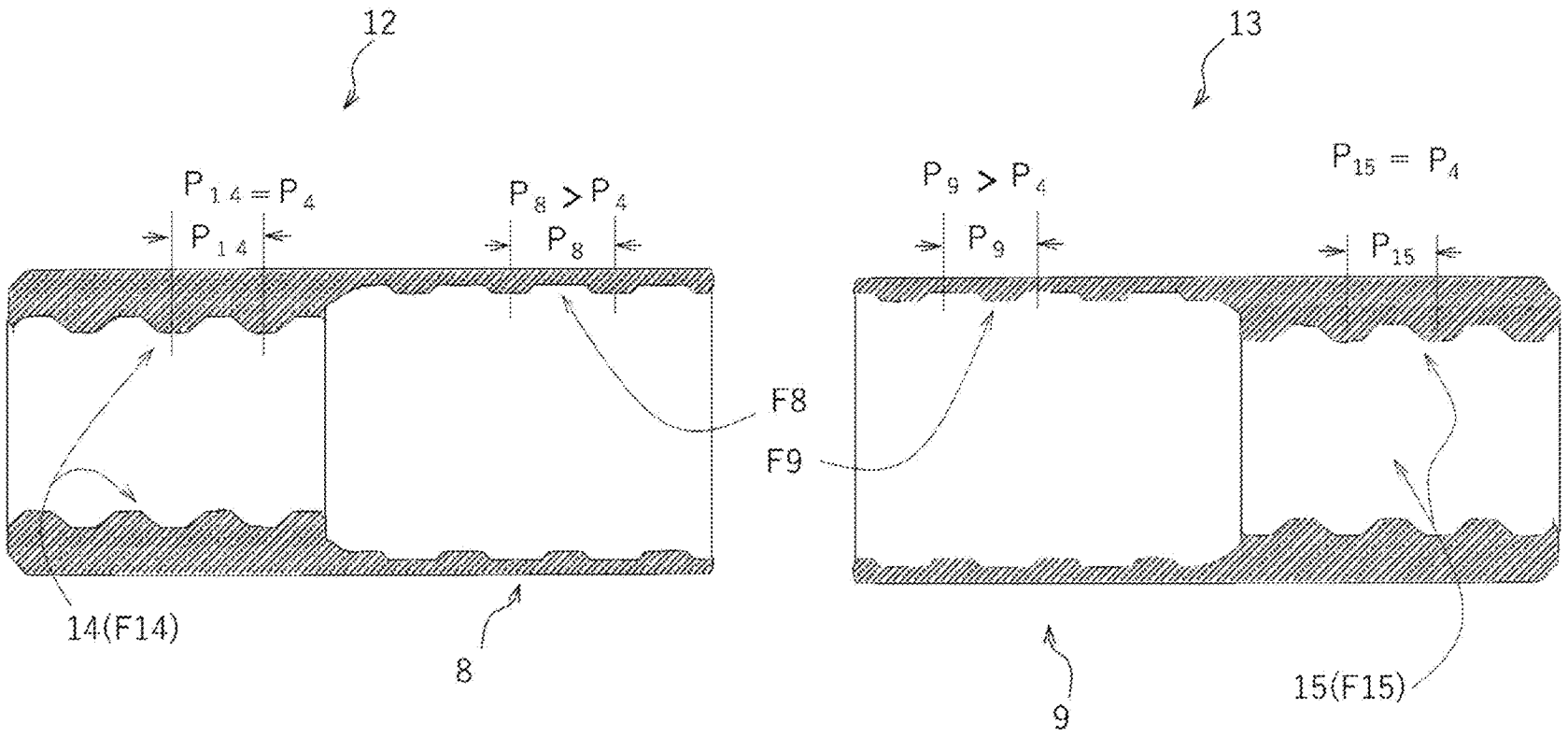
FIG. 8 is a vertical cross-sectional view of the sub-cylinders.

The sub-cylinders 12, 13 have appearance as shown in FIG. 7. The sub-cylinders 12, 13 include sleeve portions 8, 9 respectively covering the outer periphery (see FIG. 6) of the left half body and the outer periphery of the right half body of the main cylinder 11, and nut portions 14, 15 being coaxial with the sleeve portions and formed integrally with one side end of the sleeve portions. In the inside of the sleeves, sleeve inner peripheral screws F8, F9 (see FIG. 2(*b*) and FIG. 7) meshing with the outer peripheral screws 6, 7 (see FIGS. 4 and 6) described above are provided. The nut portions 14, 15 are formed with nut portion female screws F14, F15 (see FIGS. 2(*b*), 7, and 8) to which the thread M4 of the reinforcing bar having a phase matching a phase of the sleeve inner peripheral screws F8, F9 is screwed. That is, the screw pitches $P_{14}$, $P_{15}$ (see FIG. 3(*c*)) of the nut portion female screws F14, F15 are made to be equal to the thread pitch $P_4$ in the reinforcing bar tolerable minimum molded article (this means an article conforming to a reference dimension of a manufacturing drawing). The number of the threads meshing with the reinforcing bar 4 by the nut portion female screws F14, F15 are set to the number of threads of meshing that enables a fastening effect in the outer periphery of the left half body and the outer periphery of the right half body of the main cylinder 11.

Accordingly, as shown in FIG. 2(*b*), in the coupler 10, the through hole H5 and the nut portion female screws F14, F15 are formed, the nut portion female screw F14, the female screw F5 of the through hole H5, and the nut portion female screw F15 form a screw hole of the fixed pitch $P_4$ and end portions of the left and right reinforcing bars 4L, 4R can be enclosed.

As shown in FIG. 3(*b*), as a result, all phases of the female screw F5 of the through hole H5, the end portion male screws M6, M7 of the outer peripheral screws 6, 7, the sleeve inner peripheral female screws F8, F9, and the nut portion female screws F14, F15 are made to be the same.

Figure 9:
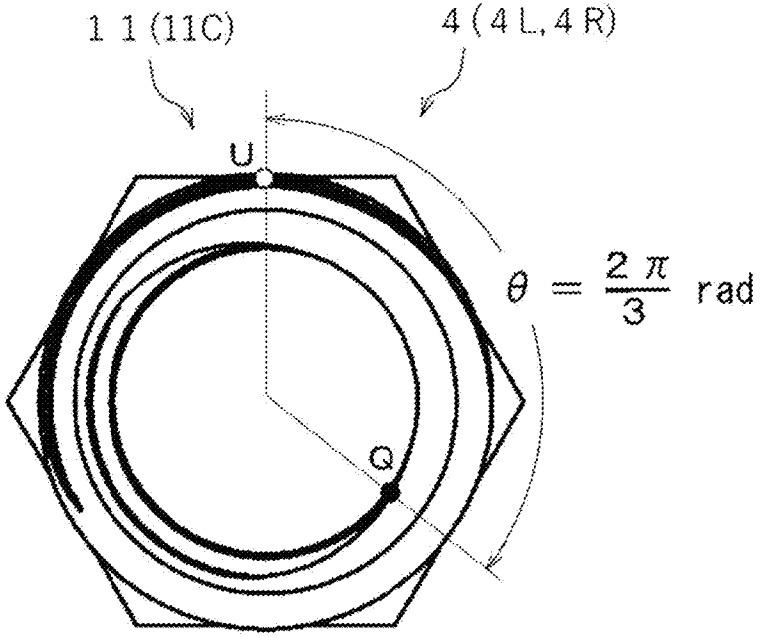
FIG. 9 is a view of a screw end surface with a point Q indicating a start of meshing in the sub-cylinders.

The same phase means that a rotation angle of a screw end at the time of start of meshing of screws is the same. That is, the rotation here refers to a rotation angle θ in FIG. 9 at a time point when the distal end of the male screw is caused to fall into the opening of the female screw and at a time point when meshing starts. The same rotation angle at the time of start of meshing, that is, the same rotation angle position of meshing start results in that meshing is collectively started by an advancing angle (for example, 2π/3 rad 120 degrees) from a point U with reference to an angle at which a threading attachment (spiral) start point Q exists.

According to a screw group having such a configuration, by applying a desired torque enabling fastening strength to be held to the nut portions 14, 15 (see FIG. 7) and causing the nut portions 14, 15 to rotate and perform screw advancement while obtaining a reaction force with the reaction force torque application surface 11C (see FIG. 4) of a polygonal cross-section, the nut portion female screws F14, F15 of the nut portion 14,15 tightly pressure-contacts with the thread M4 of the reinforcing bars 4L, 4R to exhibit a frictional force (see FIG. 3(*c*)), this means occurrence of galling). As a result, unintended rotation and axial displacement of the reinforcing bar can be prevented.

As shown in FIG. 6, the through hole H5 at the longitudinal middle portion of the main cylinder 11 is formed with a slit 17 extending in the axial direction through which the distal end positions of the inserted reinforcing bars 4L, 4R can be viewed for observation. When a slit 18 having the same shape as the shape of the slit 17 is formed at a position facing the slit 17, an abutting end of the reinforcing bar 4 can be easily recognized by viewing through the slits so that the insertion depth of the reinforcing bar is not misjudged.

It is not easy by cutting (mechanical processing) operation to achieve that the outer peripheral screws 6, 7 (see FIG. 6) formed in the outer periphery of the left half body and the outer periphery of the right half body of the main cylinder 11 have a phase matching the phase of the female screw F5 of the through hole H5, and that the nut portion female screws F14, F15 (see FIG. 7) to which the thread M4 (see FIG. 5) of the reinforcing bar is screwed have a phase matching the phase of the sleeve inner peripheral screws F8, F9 (see FIG. 3(*b*)). As can be seen in FIG. 3(*b*), all tooth surfaces need to be simultaneously subjected to initial meshing, but the processing for achieving this should be casting. Since this matter does not relate directly to the gist of the present invention, and therefore, is not described here.

Next, a procedure of fastening reinforcing bars will be described. With reference to FIG. 2(*a*), the main cylinder 11 and the two sub-cylinders 12, 13 are arranged at a connection portion of two threaded reinforcing bars 4L, 4R. It is sufficient that the sub-cylinders 12, 13 to be used are ones having the same specifications (the same nominal diameter, pitch, phase, and the like). The sub-cylinders 12, 13 are simply arranged in right and left symmetrical. First, as shown in FIG. 2(*b*), the sleeve inner peripheral screws F8, F9 are allowed to mesh with the outer peripheral screws M6, M7 and threadingly attached deep to one side of the main cylinder 11 so as to make the screw phases match and threadingly attached deep to the other side of the main cylinder 11 so as to make the screw phases match. The center body 11C has a rectangular cross-shape (see FIG. 4) and the sub-cylinders 12, 13 have shape and dimension that cannot cover up to the center body 11C, but covers almost the entire left half body and right half body. The sub-cylinders 12, 13 are arranged in proximity to each other although they do not cover the slits 17, 18. After the initial meshing, the threaded reinforcing bar 4R is caused to approach the threaded reinforcing bar 4L (see FIG. 2(*c*)).

Figure 10:
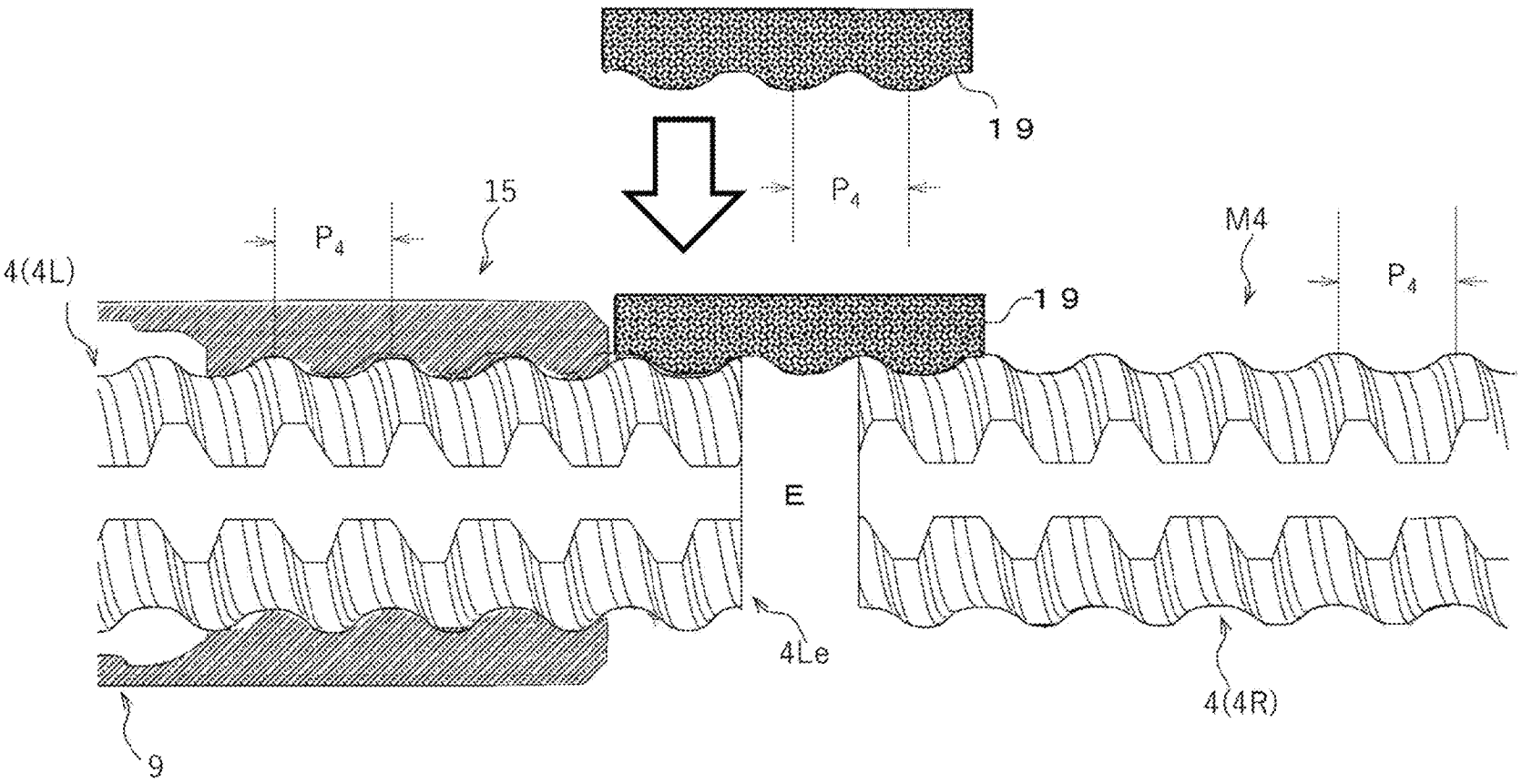
FIG. 10 is a view showing an equal pitch setting process using a gauge.

The threaded reinforcing bar 4L is caused to project from the assembled coupler 10 by about one pitch as shown in FIG. 3(*a*) until a distal end 4Le of the threaded reinforcing bar 4L protrudes, for example, and a screw-shaped gauge 19 (see FIG. 10) is applied, so that continuity of spiral of the screw is held. That is, uneven phases are prevented. As shown in FIG. 3(*b*), the entire coupler 10 is caused to move (to right by rotation). Since the nut portion female screw F14 of the sub-cylinder 12, the female screw F5 of the through hole H5 of the main cylinder 11, and the nut portion female screw F15 of the sub-cylinder 13 continue, the movement operation to the threaded reinforcing bar 4L is not difficult. That is, the end of the threaded reinforcing bar 4R and the end of the threaded reinforcing bar 4L facing each other are made to hold a predetermined gap E (see FIG. 3(*b*)) and then, the coupler 10 is caused to perform screw advancement toward the threaded reinforcing bar 4R.

Whether the end of the threaded reinforcing bar 4L and the end of the threaded reinforcing bar 4R facing each other are located at the through hole H5 as shown in FIG. 3(*b*), (*c*) is checked by viewing through the slits 17, 18 (see FIG. 4). When it is checked that they are correctly located, the sub-cylinders 12, 13 are caused to perform reverse rotation to separate in directions indicated by arrows 21, 22.

Then, the sub-cylinders 12, 13 move so as to follow the outer peripheral screws 6, 7, and the nut portion female screws F14, F15 attempt to move so as to be guided by the threaded reinforcing bar. When the sub-cylinder is rotated once, for example, the movement amount caused by guiding by the outer peripheral screw 6 is one pitch $P_6$. At the same time, the sub-cylinders 12, 13 have to move by $P_4$+2 mm (=$P_6$) since they are screwed to the threaded reinforcing bar 4R (see FIG. 6). Although this is impossible since the sub-cylinders 12, 13 are rigid bodies, when a torque of galling is applied to the screw thread of the coupler 10, interference of tooth surfaces occurs between the nut portion female screws F14, F15 to which the thread of the reinforcing bar is screwed and the thread M4 of the reinforcing bar 4R, and a damage occurs, so that the nut portion female screws F14, F15 are in a galling state due to the screw of the reinforcing bar 4R to which the nut portion female screws F14, F15 are screwed.

This means that the nut portion female screws F14, F15 cannot perform not only screw advancement but also retreat (be loosened) anymore. In fastening release operation in a case of finding a fastening error or the like, when the screw thread can be repaired even though it cannot be perfectly repaired, the lock state is released.

Figure 11:
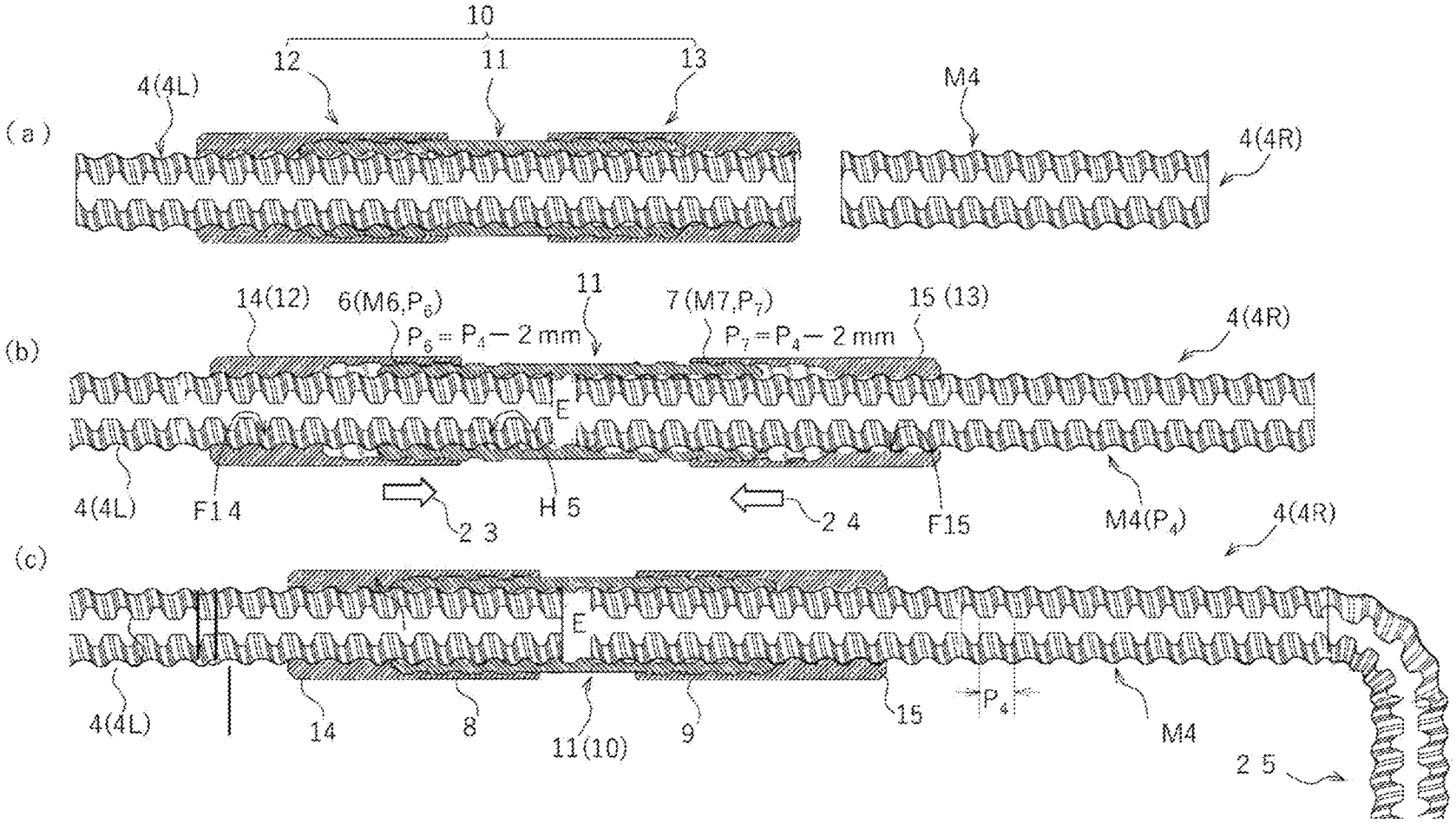
FIG. 11 is a view showing a latter half process of a procedure of fastening reinforcing bars having different pitch modes and is a view of application to a reinforcing bar having a fixation action.

In contrast to the above example, in a case of $P_4$=$P_6$+2 mm (that is, $P_6$=$P_4$−2 mm), the sub-cylinders 12, 13 are rotated to right and caused to approach in directions indicated by arrows 23, 24 as shown in FIG. 11(*b*). Since the nut portion female screws F14, F15 attempt to move by being guided by the threaded reinforcing bar 4R, so that galling in the outer peripheral screws M6, M7 first occurs.

The sub-cylinders 12, 13 also attempt to move along the outer peripheral screws 6, 7. This is because, when the sub-cylinders 12, 13 move by an amount of one rotation, for example, along the male screw M4 of the reinforcing bar, the sub-cylinders 12, 13 have to move by the pitch $P_6$+2 mm along the outer peripheral screw 6.

As can be understood from these explanations of operation, although there is a case of moving both the threaded reinforcing bars 4L, 4R in the axial direction, there is no need to cause the threaded reinforcing bars 4L, 4R to rotate for screw advancement or screwing. That is, fastening is achieved only by rotation operation of the main cylinder 11 and the sub-cylinders 12, 13.

Figure 1:
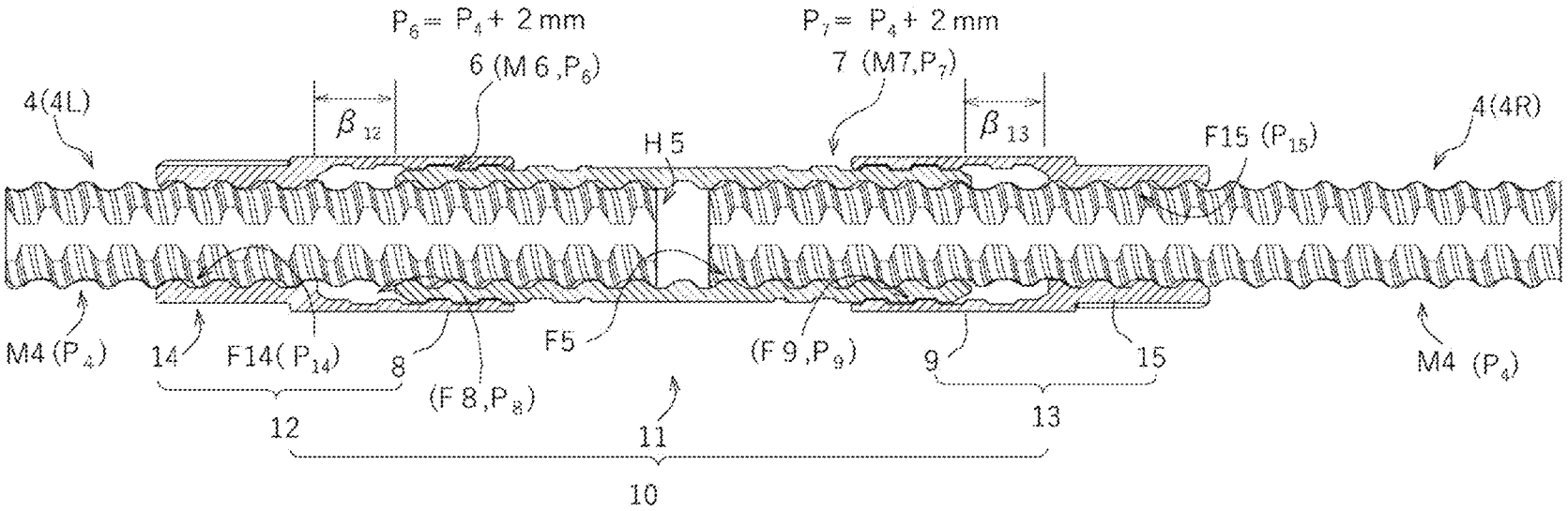
FIG. 1 is a view showing completion of fastening of reinforcing bars by a coupler for a threaded reinforcing bar according to a first embodiment of the present invention.

Essential configurations for achieving the operation described above are represented as below. With reference to FIG. 1, a coupler to which end portions facing each other reinforcing bars 4L, 4R having the same specifications (the same diameter, the same pitch, and the same screw phase) are inserted, the coupler being fastened to the reinforcing bars in order to prevent loosening of the reinforcing bars and the coupler and make the reinforcing bars through which an axial force is transmitted long, in which the coupler 10 includes one main cylinder 11, and two sub-cylinders 12, 13 threadingly attached to an outer periphery of a left half body and an outer periphery of a right half body of the main cylinder 11 in a right and left symmetrical posture, a hole in an axial direction formed in the main cylinder 11 is a vertically passing screw hole H5 to which a thread M4 of the reinforcing bars 4L, 4R is screwed, outer peripheral screws 6, 7 being concentric with the vertically passing screw hole H5 and having a larger diameter than the vertically passing screw hole H5 are formed in the outer peripheries of the right and left half bodies, end portion male screws M6, M7 are provided in the outer peripheral screws 6, 7, the end portion male screws M6, M7 have a phase that matches a phase of a female screw F5 of the through hole H5, and have pitches $P_6$, $P_7$ that are different from a screw pitch $P_4$ of the thread M4 of the reinforcing bars 4L, 4R, the sub-cylinders 12, 13 include sleeve portions 8, 9 including end portion female screws F8, F9 threadingly attached to the end portion male screws M6, M7, and nut portions 14, 15 being coaxial with the sleeve portions and formed integrally with one side ends of the sleeve portions, and the nut portions 14, 15 are formed with nut portion female screws F14, F15 to which the thread M4 of the reinforcing bars 4L, 4R is screwed, the nut portion female screws F14, F15 having a phase that matches a phase of the end portion female screws F8, F9.

Here, in a case of (1) $P_8=P_{14}+2$ mm or $P_9=P_{15}+2$ mm, when the sub-cylinders 12, 13 are separated from each other, galling occurs in $P_{14}$, $P_{15}$. In a case of (2) $P_{14}=P_8+2$ mm or $P_{15}=P_9+2$ mm, when the sub-cylinders 12, 13 are caused to approach each other, galling occurs in $P_8$, $P_9$. Since $P_4 \neq P_{14} \neq P_{15}$ and $P_6 \neq P_7 \neq P_8 \neq P_9$ are set, galling occurs in a chain reaction manner sometimes in meshing portions having a pitch difference excluding normal meshing portions.

Figure 12:
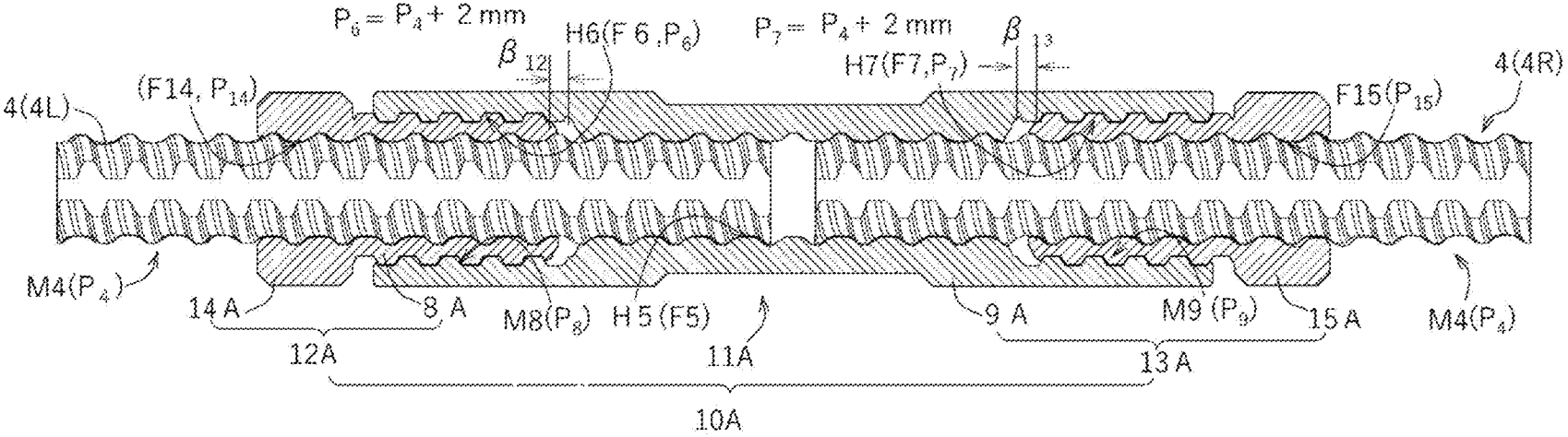
FIG. 12 is a view showing completion of fastening of reinforcing bars according to a second embodiment of the present invention in which female and male of threading attachment of the main cylinder and the sub-cylinders are made inversed.

As described above, according to the present invention, a lock using galling due to strong contact between screw tooth surfaces is achieved. In the present invention, a desired lock using galling can be achieved not only in the configuration of FIG. 1 but also in the configuration as shown in FIG. 12 in which female and male of the screws of the main cylinder 11 and the sub-cylinders 12, 13 are inversed.

The configuration can be represented as below.

A coupler to which end portions of reinforcing bars 4L, 4R facing each other are inserted, the coupler being fastened to the reinforcing bars in order to prevent loosening of the reinforcing bars and the coupler and make the reinforcing bars through which an axial force is transmitted long, in which the coupler 10A includes one main cylinder 11A, and two sub-cylinders 12A, 13A screwed to an inner hole of a left half body and an inner hole of a right half body of the main cylinder in a right and left symmetrical posture, a hole in an axial direction formed in the main cylinder 11A is a vertically passing screw hole H5 to which a thread M4 of the reinforcing bars is screwed, end portion female screw holes H6, H7 being concentric with the vertically passing screw hole H5 and having a larger diameter than the vertically passing screw hole H5 are formed in the inner holes of the right and left half bodies, end portion female screws F6, F7 are provided in the end portion female screw holes H6, H7, the end portion female screws F6, F7 have a phase that matches a phase of a female screw F5 of the through hole H5, and have pitches $P_6$, $P_7$ that are different from a screw pitch $P_4$ of the thread M4 of the reinforcing bars 4L, 4R, the sub-cylinders 12A, 13A include sleeve portions 8A, 9A including end portion male screws M8, M9 screwed to the end portion female screws F6, F7, and nut portions 14A, 15A being coaxial with the sleeve portions and formed integrally with one side ends of the sleeve portions, and the nut portions 14A, 15A are formed with nut portion female screws F14, F15 to which the thread M4 of the reinforcing bars 4L, 4R is screwed, the nut portion female screws F14, F15 having a phase that matches a phase of the end portion male screws M8, M9.

Here, in a case of (1) $P_8=P_{14}+2$ mm or $P_9=P_{15}+2$ mm, when the sub-cylinders 12A, 13A are separated from each other, galling occurs in $P_{14}$, $P_{15}$. In a case of (2) $P_{14}=P_8+2$ mm or $P_{15}=P_9+2$ mm, when the sub-cylinders 12A, 13A are caused to approach each other, galling occurs in $P_8$, $P_9$. Since $P_4 \neq P_{14} \neq P_{15}$ and $P_6 \neq P_7 \neq P_8 \neq P_9$ are set, galling occurs in a chain reaction manner sometimes in meshing portions having a pitch difference excluding normal meshing portions.

The followings can be understood from the above description. The reinforcing bars to be connected are bonded with equivalent components and can be fastened by torque loading operation in a similar manner. If the reinforcing bars have a thread within a molding tolerance, even when there is variation in the thread pitches, homogenization of fastening of reinforcing bars can be achieved. Since there is a difference in the pitch between the outer peripheral screws (or end portion female screws) of the outer periphery of the left half body and the outer periphery of the right half body of the main cylinder and the thread of the reinforcing bar, a frictional force acting on a screw surface becomes large due to an increase in a screw surface contact pressure. When surface roughness of a screw thread occurs by pressurization, screw advancement or retreat thereafter is inhibited, so that galling occurs in a chain reaction manner sometimes in meshing portions having a pitch difference excluding normal meshing portions.

Since the outer peripheral screw (or the end portion female screw) having a pitch larger than the pitch of the thread of the reinforcing bar is formed or the outer peripheral screw (or the end portion female screw) having a pitch smaller than the pitch of the thread of the reinforcing bar is formed in the outer periphery of the left half body and the outer periphery of the right half body of the main cylinder, it is possible to specify a screw to which a frictional force acting on the screw surface due to a surface pressure contact of the screw acts large, so that material selection of the main cylinder is facilitated.

When a reaction receiving surface is formed on an outer surface of the through hole being a longitudinal center portion of the main cylinder, reaction receiving operation at the time of applying a desired torque to a polygonal nut portion is facilitated.

When a slit extending in the axial direction is formed in the through hole being a longitudinal middle portion of the main cylinder, the distal end position of the inserted reinforcing bar can be checked. When another slit having the same shape as the slit is formed in a position facing the slit, viewing through is enabled and checking of the distal end position of the inserted reinforcing bar is facilitated.

The through hole has been generally described to be a right-hand screw both in the left half body and the right half body. When the reinforcing bar is a left-hand screw, surface roughness is caused by operation of causing the sub-cylinders to reverse-rotate with respect to each other and approach each other.

By providing a bending portion in the end portion in the side opposite to the coupler of the reinforcing bar, the reinforcing bar can have a fixation function. Although the fixation portion is planned in advance, it has an advantage that correspondence in a case where a change is required becomes rapid. Note that, in the present invention, there is no intention of excluding using of grout (mortar, adhesive, screw lock agent, or the like). That is, in the configuration of the present invention, introduction of grout or the like is not inhibited and injection of grout is considered to be unnecessary in principle in many cases. It is needless to say that grout can be used for locking in a known manner. The desired lock using galling can be achieved also in a configuration including a main cylinder and sub-cylinders in which females and males of screws of the main cylinder and sub-cylinders are inversed.

REFERENCE NUMERALS

4, 4L, 4R Threaded reinforcing bar
M4 Thread
4Le Distal end of threaded reinforcing bar
6, 7 Outer peripheral screw
H6, H7 End portion female screw hole
F6, F7 End portion female screw
M6, M7 End portion male screw
10, 10A Coupler
11, 11A Main cylinder
11C Center body (reaction receiving surface)
12, 12A, 13, 13A Sub-cylinder
H5 Vertically passing screw hole
F5 Female screw
8, 8A, 9, 9A Sleeve portion
F8, F9 Sleeve inner peripheral screw
M8, M9 Sleeve portion male screw
14, 14A, 15, 15A Nut portion
F14, F15 Nut portion female screw
17, 18 Slit
19 Gauge
21, 22 Arrow to separation direction
23, 24 Arrow to approach direction
25 Bending portion
P4 Pitch of thread in tolerable minimum molded article
P6, P7 Screw pitch of end portion male (or female) screw
E Reinforcing bar end abutting space
Q Threading attachment (spiral) start point in sub-cylinder
U Angle reference point defining point Q
θ Rotation angle at meshing start

What is claimed is:

1. A coupler for a threaded reinforcing bar to which end portions of reinforcing bars facing each other are inserted and that fastens, in an axial direction, the reinforcing bars facing each other, the coupler comprising a main cylinder, and sub-cylinders that can be screwed with the main cylinder in both end portions in the axial direction of the main cylinder, wherein the main cylinder includes a male screw portion formed in an outer peripheral portion, and a female screw portion formed in an inner peripheral portion, the sub-cylinders each include:

a first female screw portion that is formed in an inner peripheral portion on a side of the main cylinder in the axial direction and screwed with the male screw portion of the main cylinder, and a second female screw portion that is formed in the inner peripheral portion on a side opposite to the side of the main cylinder in the axial direction and screwed with a thread of the reinforcing bar, a phase of the female screw portion of the main cylinder, a phase of the first female screw portions of the sub-cylinders, and a phase of the second female screw portions of the sub-cylinders are the same, the male screw portion of the main cylinder is screwed with the first female screw portions of the sub-cylinders, and the female screw portion of the main cylinder and the second female screw portions of the sub-cylinders are screwed with the threads of the reinforcing bars, and a screw pitch of the male screw portion of the main cylinder is different from a screw pitch of the threads of the reinforcing bars.

2. A coupler for a threaded reinforcing bar to which end portions of reinforcing bars facing each other are inserted, and that fastens, in an axial direction, the reinforcing bars facing each other, the coupler comprising a main cylinder, and sub-cylinders that can be screwed with the main cylinder in both end portions in the axial direction of the main cylinder, wherein the main cylinder includes a male screw portion formed in an outer peripheral portion, the sub-cylinders each include a first female screw portion that is formed in an inner peripheral portion on a side of the main cylinder in the axial direction and screwed with the male screw portion of the main cylinder, and a second female screw portion that is formed in the inner peripheral portion on a side opposite to the side of the main cylinder in the axial direction and screwed with a thread of the reinforcing bar, a phase of the first female screw portions of the sub-cylinders and a phase of the second female screw portions of the sub-cylinders are the same, the male screw portion of the main cylinder is screwed with the first female screw portions of the sub-cylinders, and the second female screw portions of the sub-cylinders are screwed with the threads of the reinforcing bars, and a screw pitch of the male screw portion of the main cylinder is different from a screw pitch of the threads of the reinforcing bars.

3. The coupler for a threaded reinforcing bar as claimed in claim 1 or 2, wherein the male screw portion of the main cylinder is formed with a male screw having a pitch larger than a pitch of the threads of the reinforcing bars.

4. The coupler for a threaded reinforcing bar as claimed in claim 1 or 2, wherein the male screw portion of the main cylinder is formed with a male screw having a pitch smaller than a pitch of the threads of the reinforcing bars.

5. A coupler for a threaded reinforcing bar to which end portions of reinforcing bars facing each other are inserted and that fastens, in an axial direction, the reinforcing bars facing each other, the coupler comprising a main cylinder, and sub-cylinders that can be screwed with the main cylinder in both end portions in the axial direction of the main cylinder, wherein the main cylinder includes a first female screw portion formed in a part of an inner peripheral portion, and a second female screw portion formed in an inner peripheral portion on a side of an end portion further in the axial direction than the first female screw portion, the sub-cylinders each include a male screw portion that is formed in an outer peripheral portion and screwed with the second female screw portion of the main cylinder, and a female screw portion that is formed in an inner peripheral portion and screwed with a thread of the reinforcing bar, a phase of the first female screw portion of the main cylinder, a phase of the second female screw portion of the main cylinder, and a phase of the female screw portions of the sub-cylinders are the same, the second female screw portion of the main cylinder is screwed with the male screw portions of the sub-cylinders, and the first female screw portion of the main cylinder and the female screw portions of the sub-cylinders are screwed with the threads of the reinforcing bars, and a screw pitch of the male screw portions of the sub-cylinders is different from a screw pitch of the threads of the reinforcing bars.

6. A coupler for a threaded reinforcing bar to which end portions of reinforcing bars facing each other are inserted and that fastens, in an axial direction, the reinforcing bars facing each other, the coupler comprising a main cylinder, and sub-cylinders that can be screwed with the main cylinder in both end portions in the axial direction of the main cylinder, wherein the main cylinder includes a female screw portion formed in a part of an inner peripheral portion, the sub-cylinders each include a male screw portion that is formed in an outer peripheral portion and screwed with the female screw portion of the main cylinder, and a female screw portion that is formed in an inner peripheral portion and screwed with a thread of the reinforcing bar, a phase of the female screw portion of the main cylinder and a phase of the female screw portions of the sub-cylinders are the same, the female screw portion of the main cylinder is screwed with the male screw portions of the sub-cylinders, and the female screw portions of the sub-cylinders are screwed with the threads of the reinforcing bars, and a screw pitch of the male screw portions of the sub-cylinders is different from a screw pitch of the threads of the reinforcing bars.

7. The coupler for a threaded reinforcing bar as claimed in claim 5 or 6, wherein the male screw portions of the sub-cylinders are each formed with a male screw having a pitch larger than a pitch of the threads of the reinforcing bars.

8. The coupler for a threaded reinforcing bar as claimed in claim 5 or 6, wherein the male screw portions of the sub-cylinders each are formed with a male screw having a pitch smaller than a pitch of the threads of the reinforcing bars.

9. The coupler for a threaded reinforcing bar as claimed in claim 1, 2, 5, or 6, wherein an outer surface of a center body being a longitudinal center portion of the main cylinder is formed with a reaction receiving surface used in application of a desired torque to the sub-cylinder.

10. A threaded reinforcing bar comprising the coupler for a threaded reinforcing bar as claimed in claim 1, 2, 5, or 6.

* * * * *